US009187802B2

(12) United States Patent
Aimone et al.

(10) Patent No.: US 9,187,802 B2
(45) Date of Patent: Nov. 17, 2015

(54) NIOBIUM BASED ALLOY THAT IS RESISTANT TO AQUEOUS CORROSION

(75) Inventors: Paul R. Aimone, Bridgewater, MA (US); Prabhat Kumar, Framingham, MA (US)

(73) Assignee: H.C. Stark Inc., Newton, MA (US)

( * ) Notice: Subject to any disclaimer, the term of this patent is extended or adjusted under 35 U.S.C. 154(b) by 338 days.

(21) Appl. No.: 12/915,781

(22) Filed: Oct. 29, 2010

(65) Prior Publication Data

US 2011/0041650 A1 Feb. 24, 2011

Related U.S. Application Data

(62) Division of application No. 12/498,770, filed on Jul. 7, 2009.

(51) Int. Cl.

| | |
|---|---|
| ***C22B 9/22*** | (2006.01) |
| ***C22B 9/16*** | (2006.01) |
| ***C22B 9/00*** | (2006.01) |
| ***C22B 34/24*** | (2006.01) |
| ***C22B 34/20*** | (2006.01) |
| ***C22C 27/02*** | (2006.01) |

(52) U.S. Cl.

CPC ..... *C22B 9/226* (2013.01); *C22B 9/228* (2013.01); *C22B 34/24* (2013.01); *C22C 27/02* (2013.01)

(58) Field of Classification Search

None

See application file for complete search history.

(56) References Cited

U.S. PATENT DOCUMENTS

| | | | | |
|---|---|---|---|---|
| 1,167,827 | A * | 1/1916 | Kaiser | 419/46 |
| 3,109,734 | A | 11/1963 | Bishop et al. | |
| 3,592,639 | A | 7/1971 | Schussler et al. | |
| 3,775,096 | A | 11/1973 | Guidotti et al. | |
| 4,062,679 | A | 12/1977 | Marsh et al. | |
| 4,784,830 | A | 11/1988 | Ganesan et al. | |
| 6,800,392 | B2 | 10/2004 | Jantsch et al. | |
| 2005/0142021 | A1 * | 6/2005 | Aimone et al. | 419/19 |
| 2007/0056660 | A1 | 3/2007 | Aoki et al. | |
| 2008/0267809 | A1 | 10/2008 | Aimone et al. | |

FOREIGN PATENT DOCUMENTS

| | | | |
|---|---|---|---|
| DE | 1164675 B | 3/1964 | |
| DE | 1199005 | 8/1965 | |
| GB | 1072829 | 6/1967 | |
| JP | 04021736 | 1/1992 | |
| JP | 2006-299302 | * 11/2006 | C22B 9/20 |
| WO | WO-91/19015 A1 | 12/1991 | |
| WO | WO-02/05863 | 1/2002 | |

OTHER PUBLICATIONS

Environmental Effects on Engineered Materials 170-172 (Russell Jones ed., 2001).*

Corrosion Engineering Handbook 181 (Philip Schweitzer ed., 1996).*

(Continued)

*Primary Examiner* — Yoshitoshi Takeuchi

(74) *Attorney, Agent, or Firm* — Morgan, Lewis & Bockius LLP

(57) ABSTRACT

A niobium or niobium alloy which contains pure or substantially pure niobium and at least one metal element selected from the group consisting of Ru, Rh, Pd, Os, Ir, Pt, Mo, W and Re to form a niobium alloy that is resistant to aqueous corrosion. The invention also relates to the process of preparing the niobium alloy.

19 Claims, 2 Drawing Sheets

(56) References Cited

OTHER PUBLICATIONS

English translation of Yokoyama JP2006-299302 (2006).*
Gypen L A et al., "Corrosion resistance of tantalum base alloys. Elimination of hydrogen embrittlement in tantalum by substitutional alloyin" vol. 35, No. 2, Feb. 1, 1984.
Frank T. Sisco & Edward Epremian, "Columbium and Tantalum", John Wiley & Sons, Inc., Copyright 1963, pp. 308-310.
GL Miller, "Tantalum and Niobium", Academic Press Inc. Publishers, Copyright 1959, pp. 433-439.
ASM Handbook (ASM Handbook vol. 2 Properties and Selection: Nonferrous Alloys and Special-Purpose Materials, Joseph Davis ed., ASM International, 10th ed. 1990).
Paul Aimone et al., Working with Tantalum and Tantalum Alloys, 2003 NACE Conference proceedings.
Chemistry Explained: Niobium (2006) (available at http://www.chemistryexplained.com/elements/L-P/Niobium.html).
Search Report and Written Opinion from International Searching Authority dated Aug. 6, 2008.
Search Report and Written Opinion from International Searching Authority dated Sep. 21, 2010.
U.S. Appl. No. 12/915,681, filed Oct. 29, 2010, Aimone et al.
U.S. Appl. No. 12/109,765, filed Apr. 25, 2008, Aimone et al.
U.S. Appl. No. 12/915,681, filed Oct. 29, 2010, Aimone, et al.

* cited by examiner

NIOBIUM BASED ALLOY THAT IS RESISTANT TO AQUEOUS CORROSION

RELATED APPLICATIONS

This Application is a Division of U.S. patent application Ser. No. 12/498,770, filed on Jul. 7, 2009 which is incorporated by reference its entirety.

FIELD OF THE INVENTION

The invention is directed to niobium or niobium based alloys that are resistant to aqueous corrosion, more particularly to corrosion from acids and resistant to hydrogen embrittlement. The niobium or niobium based alloy has superior resistance to hydrogen absorption (and subsequent hydrogen embrittlement) as compared to pure niobium

BACKGROUND OF THE INVENTION

Pure niobium begins to become significantly hydrogen embrittled at hydrogen concentrations greater than 100 ppm. In the chemical processing industry (CPI), pure niobium will absorb hydrogen and become embrittled when exposed to hot HCl and hot $H_2SO_4$ at conditions illustrated in FIGS. 1 and 2. Where niobium and niobium alloys are used in the CPI to contain hot and concentrated acids, hydrogen embrittlement, rather than a loss of wall thickness due to corrosion, is the predominant failure mechanism.

U.S. Pat. No. 4,784,830 discloses that oxidation resistance of alloys can be improved by a controlled addition and retention of nitrogen. Put another way, it has been discovered that the microstructure of the alloys of the type under consideration, notably grain size, can be controlled or rendered relatively structurally stable over extended periods at elevated temperature through a microalloying addition of nitrogen. In addition, and most advantageously, a special ratio of silicon to titanium should be observed in seeking extended service life as will be shown herein.

U.S. Pat. No. 3,592,639 relates to a ternary Ta—W alloy which contains from 1.5 to 3.5 percent of tungsten. Niobium can also be present in the alloy from 0.05 to 0.5 weight percent. Molybdenum is limited to 0.5% maximum (less than 5000 p.p.m.) to promote smaller grain size in the alloy.

U.S. Pat. No. 4,062,679 claims a wrought tantalum product of, substantially pure tantalum containing less than 300 parts per million of columbium, less than 200 parts per million of iron, chromium and nickel combined, less than 50 parts per million of tungsten, less than 10 parts per million of molybdenum, less than 30 parts per million of chromium, and less than 20 parts per million of calcium, the improvement which comprises the inclusion of from about 50 to about 700 parts per million of silicon in the composition of said product whereby said product is improved in resistance to embrittlement when exposed to elevated temperatures in an oxygen-containing environment.

SUMMARY OF THE INVENTION

The invention relates to a process of improving corrosion and hydrogen embrittlement resistance by microalloying at least one metal element selected from the group consisting of Ru, Rh, Pd, Os, Ir, Pt, Mo, W and Re with a pure or substantially pure niobium or a niobium alloy.

The most preferred embodiment of this invention would add ruthenium, palladium, or platinum to niobium. The chemical process industry is seeking new niobium alloys that will permit greater operating temperatures in their process equipment.

An object of the invention is to have an improved niobium alloy which is more resistant to aqueous corrosion and hydrogen embrittlement.

The invention also relates to a niobium alloy which comprises pure or substantially pure niobium or a niobium alloy and at least one metal element selected from the group consisting of Ru, Rh, Pd, Os, Ir, Pt, Mo, W and Re to form a niobium alloy that is resistant to aqueous corrosion.

The metal element(s) can be in an amount up to the solubility limit of metal in the niobium.

DETAILED DESCRIPTION OF THE INVENTION

Figure 1:
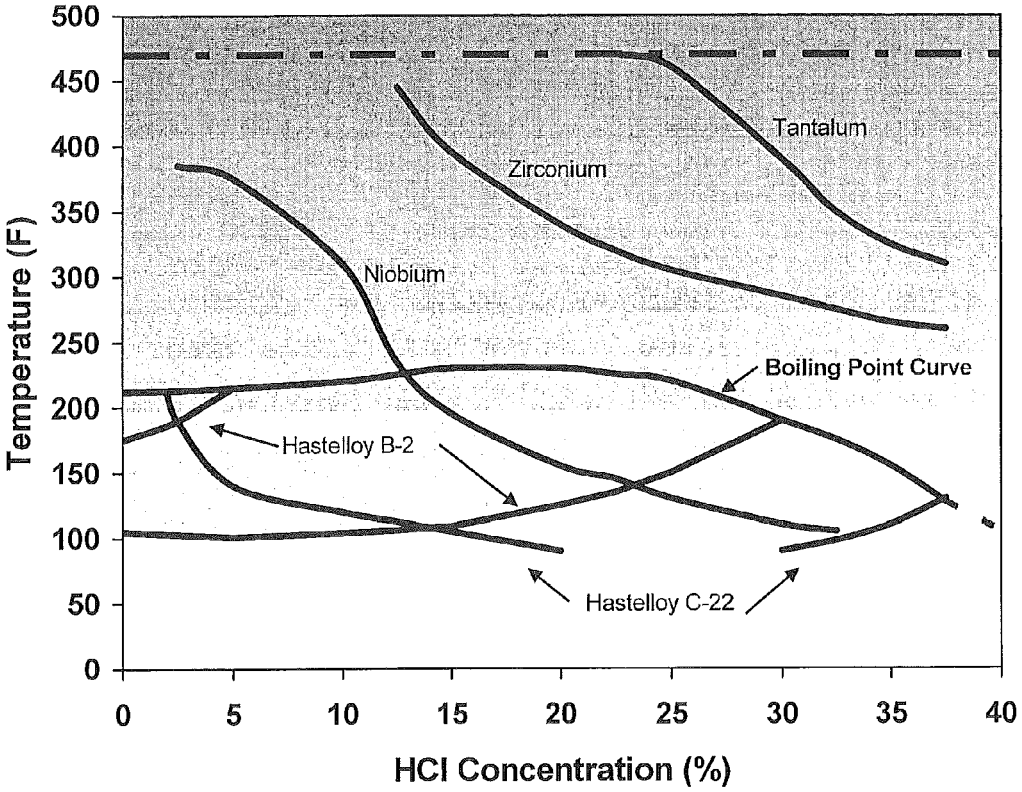
FIG. 1 illustrates the conditions for the chemical processing industry that pure niobium will absorb hydrogen and become embrittled when exposed to hot HCl.
Figure 2:
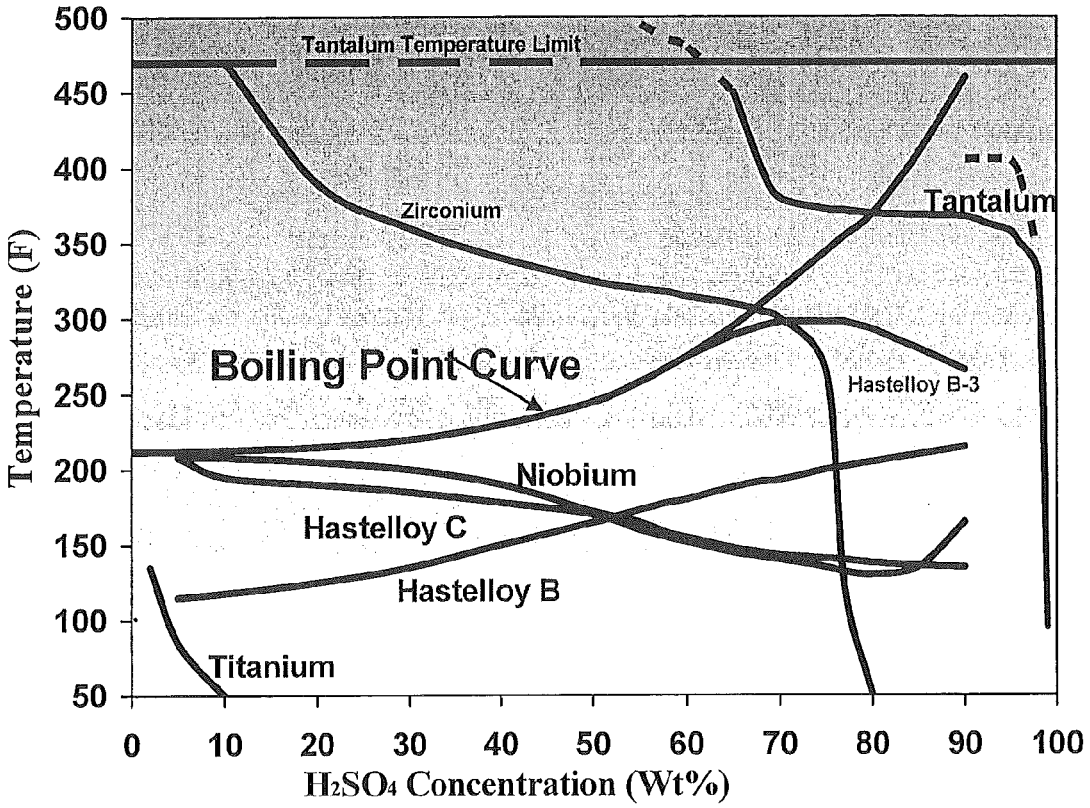
FIG. 2 illustrates the conditions for the chemical processing industry that pure niobium will absorb hydrogen and become embrittled when exposed to hot $H_2SO_4$.

As used herein, the singular terms "a" and "the" are synonymous and used interchangeably with "one or more." Accordingly, for example, reference to "a metal" herein or in the appended claims can refer to a single metal or more than one metal. Additionally, all numerical values, unless otherwise specifically noted, are understood to be modified by the word "about."

A niobium or niobium based alloy that is resistant to aqueous corrosion, more particularly to corrosion from acids and resistant to hydrogen embrittlement. The starting niobium is pure or substantially pure. Substantially pure niobium would be a niobium alloy which has up to about 11% by weight of non-niobium components, and preferably up to 5% by weight of non-niobium components.

The niobium or niobium based alloys are preferably prepared using a vacuum melting process. Vacuum arc remelting (VAR), electron beam melting (EBM) or plasma arc melting (PAM) are methods of vacuum melting that can also be used for alloying. To formulate the actual alloy, at least one element selected from the group consisting of ruthenium, rhodium, palladium, osmium, iridium, platinum, molybdenum, tungsten, and ruthenium (Ru, Rh, Pd, Os, Ir, Pt, Mo, W and Re) are added to the pure niobium material or substantially pure niobium material or niobium alloy using one of the vacuum melting processes listed above. Although it is noted that VAR, EBM or PAM could all be used. The preferred technique would be VAR.

Alternative embodiments of this invention could include adding elements other than the elements listed above that improve the corrosion and hydrogen embrittlement resistance. These additional elements could include yttrium, gold, cerium, praseodymium, neodymium, and thorium.

Each of the metals would preferably be less than 10,000 ppm of the alloy, preferably less than 5,000 ppm of the total amount of the alloy and more preferably less 2,000 ppm of the total amount of alloy. The metal preferably would be added in an amount of at least 50 ppm, preferably at least 100 ppm, preferably at least 150 ppm, preferably at least 200 ppm and preferably at least 250 ppm.

The addition of ruthenium, palladium, or platinum would be the most preferred embodiment since these elements provide sites of low hydrogen overvoltage thereby stabilizing the $Nb_2O_5$ oxide layer.

Another preferred embodiment would use the addition ofrhodium, osmium, and iridium (also known as "platinum group metals, PGM) which also would provide sites of low hydrogen overvoltage thereby stabilizing the $Nb_2O_5$ oxide layer.

Still another preferred embodiment would use the addition of molybdenum since it has the same crystal structure, a similar lattice parameter, and complete solid solubility in both niobium and tungsten. This is shown in Table I and FIG. 1.

TABLE I

Crystal Structure and Lattice Parameters for Refractory Elements

| Element | Symbol | Crystal Structure | Lattice Parameter (Å) |
|---|---|---|---|
| Niobium | Nb | body centered cubic (bcc) | 3.301 |
| Tungsten | W | body centered cubic (bcc) | 3.16 |
| Molybdenum | Mo | body centered cubic (bcc) | 3.15 |
| Platinum | Pt | face centered cubic (fcc) | 3.931 |
| Rhenium | Re | hexagonal close packed (hcp) | a = 2.761, c = 4.458 |

Another preferred embodiment would use the addition of rhenium since rhenium has the same crystal structure and a similar lattice parameter to niobium and tungsten.

Niobium ingots formulated using VAR or PAM would then be used to produce plate, sheet, and tube products in a manner similar to that used to manufacture these same products from pure niobium or niobium alloy.

The advantages of the new alloys would be superior corrosion and hydrogen embrittlement resistance over pure niobium. The addition of ruthenium, palladium, or platinum would be the preferred embodiment since these elements provide sites of low hydrogen overvoltage thereby stabilizing the $Nb_2O_5$ oxide layer.

All the references described above are incorporated by reference in its entirety for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

We claim:

1. A process to produce a niobium alloy which is resistant to aqueous corrosion, the process comprising microalloying pure or substantially pure niobium and at least one metal element selected from the group consisting of Ru, Rh, Pd, Os, Ir, Pt, Mo, W and Re and wherein (i) the microalloying is performed to produce the niobium alloy via laser additive manufacturing (LAM), vacuum arc remelting (VAR), electron beam melting (EBM), or plasma arc melting (PAM), and (ii) each said at least one metal element is present in an amount of less than 10,000 ppm in the alloy.

2. The process as claimed in claim 1, wherein the at least one metal element comprises platinum.

3. The process as claimed in claim 1, wherein the at least one metal element comprises ruthenium or rhodium or palladium or osmium or iridium.

4. The process as claimed in claim 1, wherein the at least one metal element comprises molybdenum or rhenium.

5. The process as claimed in claim 1, wherein each said at least one metal element is present in an amount of less than 5,000 ppm in the alloy.

6. The process as claimed in claim 1, wherein each said at least one metal element is present in an amount of less 2,000 ppm in the alloy.

7. The process as claimed in claim 1, wherein each said at least one metal element is present in an amount of at least 150 ppm in the alloy.

8. The process as claimed in claim 1, wherein the microalloying is performed via laser additive manufacturing (LAM).

9. The process as claimed in claim 1, wherein the microalloying is performed via vacuum arc remelting (VAR).

10. The process as claimed in claim 1, wherein the microalloying is performed via electron beam melting (EBM).

11. The process as claimed in claim 1, wherein the microalloying is performed via plasma arc melting (PAM).

12. The process as claimed in claim 1, wherein the substantially pure niobium contains up to 5% by weight of non-niobium components.

13. The process as claimed in claim 1, wherein each said at least one metal element is present in an amount from 150 ppm to less than 2,000 ppm in the alloy.

14. The process as claimed in claim 2, wherein each said at least one metal element is present in an amount from 150 ppm to less than 2,000 ppm in the alloy.

15. The process as claimed in claim 3, wherein each said at least one metal element is present in an amount from 150 ppm to less than 2,000 ppm in the alloy.

16. The process as claimed in claim 13, wherein the microalloying is performed via laser additive manufacturing (LAM).

17. The process as claimed in claim 14, wherein the microalloying is performed via vacuum arc remelting (VAR).

18. The process as claimed in claim 15, wherein the microalloying is performed via electron beam melting (EBM).

19. A process of improving corrosion and hydrogen embrittlement resistance of a niobium alloy, the process comprising microalloying at least one metal element selected from the group consisting of Ru, Rh, Pd, Os, Ir, Pt, Mo, W and Re with a pure or substantially pure niobium or a niobium alloy and wherein (i) the microalloying is performed to produce the niobium alloy via laser additive manufacturing (LAM), vacuum arc remelting (VAR), electron beam melting (EBM), or plasma arc melting (PAM), and (ii) each said at least one metal element is present in an amount of less than 10,000 ppm in the alloy.

* * * * *